US008748536B2

(12) United States Patent
Comeau et al.

(10) Patent No.: US 8,748,536 B2
(45) Date of Patent: Jun. 10, 2014

(54) MULTI-PIECE GOLF BALLS HAVING LAYERS MADE FROM EPOXY SYSTEMS

(75) Inventors: Brian Comeau, Berkley, MA (US); David A. Bulpett, Boston, MA (US)

(73) Assignee: Acushnet Company, Fairhaven, MA (US)

( * ) Notice: Subject to any disclaimer, the term of this patent is extended or adjusted under 35 U.S.C. 154(b) by 919 days.

(21) Appl. No.: 12/573,342

(22) Filed: Oct. 5, 2009

(65) Prior Publication Data

US 2011/0081988 A1 Apr. 7, 2011

(51) Int. Cl.

| | |
|---|---|
| ***A63B 37/00*** | (2006.01) |
| ***C08L 63/00*** | (2006.01) |
| ***C08L 9/00*** | (2006.01) |
| ***C08F 283/10*** | (2006.01) |

(52) U.S. Cl.

USPC ..... 525/112; 525/529; 525/530; 525/531; 473/373; 473/374

(58) Field of Classification Search

None

See application file for complete search history.

(56) References Cited

U.S. PATENT DOCUMENTS

| | | | | |
|---|---|---|---|---|
| 3,671,477 | A | 6/1972 | Nesbitt | |
| 5,731,371 | A | 3/1998 | Nesbitt et al. | |
| 6,737,478 | B2 | 5/2004 | Obrecht et al. | |
| 7,208,538 | B2 | 4/2007 | Taylor et al. | |
| 7,396,869 | B2 | 7/2008 | Taylor et al. | |
| 7,528,189 | B2 | 5/2009 | Taylor et al. | |
| 2003/0100385 | A1 | 5/2003 | Fushihara et al. | |
| 2003/0104880 | A1 | 6/2003 | Fushihara | |
| 2005/0009636 | A1* | 1/2005 | Kuntimaddi et al. | 473/351 |
| 2005/0037865 | A1* | 2/2005 | Yagley et al. | 473/371 |
| 2005/0154089 | A1 | 7/2005 | Taylor et al. | |
| 2006/0025238 | A1* | 2/2006 | Endo et al. | 473/371 |
| 2006/0116481 | A1* | 6/2006 | Morgan | 525/261 |
| 2007/0129510 | A1* | 6/2007 | Kuntimaddi et al. | 525/528 |
| 2009/0105012 | A1 | 4/2009 | Kamino et al. | |

* cited by examiner

*Primary Examiner* — David Buttner

(74) *Attorney, Agent, or Firm* — Daniel W. Sullivan

(57) ABSTRACT

Multi-piece, solid golf balls containing an inner core, an intermediate layer surrounding the core, and an outer cover are provided. At least one layer is made from an epoxy composition comprising a curing agent such as zinc diacrylate or zinc dimethacrylate. The epoxy composition is produced by reacting an epoxy prepolymer with a curing agent. Preferably, the epoxy composition is used to form an intermediate and/or cover layer resulting in a golf ball having high resiliency, good impact durability, and soft feel.

6 Claims, 2 Drawing Sheets

MULTI-PIECE GOLF BALLS HAVING LAYERS MADE FROM EPOXY SYSTEMS

BACKGROUND OF THE INVENTION

1. Field of the Invention

The present invention relates generally to golf balls containing at least one layer made from an epoxy composition comprising a curing agent. More particularly, the curing agent is a metallic (meth)acrylate such as zinc diacrylate ("ZDA") or zinc dimethacrylate ("ZDMA"). The composition may be used to form any layer in the golf ball structure such as, for example, a core, intermediate layer, and/or cover. Preferably, the composition is used to form an intermediate or cover layer having optimum hardness properties.

2. Brief Review of the Related Art

Epoxy compositions are used in various applications including industrial adhesives, sealants, films, and paints. Normally, epoxy resins have two components or parts. The two-part epoxy includes a diepoxy prepolymer and a diamine curing agent. The diepoxy prepolymer is a low-molecular weight polymer having terminal epoxy groups. The diepoxy prepolymer is mixed with a diamine curing agent. Upon this mixing step, the parts react and join together to form a cross-linked epoxy polymer having high adhesive strength.

There are different methods for curing epoxy prepolymers. For example, Taylor et al., U.S. Pat. Nos. 7,208,538; 7,396,869; and 7,528,189, the disclosures of which are hereby incorporated by reference, disclose using metallic diacrylate compounds such as zinc diacrylate ("ZDA"), zinc dimethacrylate ("ZDMA"), and mixtures thereof for curing epoxy functional systems. The system is substantially free of conventional curing agents such as polyamides and polyamines. The metallic diacrylate, acting as a curing agent, can provide benefits such as reduced shrinkage, improved clarity of coatings, heat-aging, and shelf-life according to the '538, '869, and '189 patents. There is no disclosure, however, for making golf balls or golf ball subassemblies or golf ball components in the '538, '869, and '189 patents.

The golf industry and consumers have adopted multi-piece solid golf balls for several reasons including ease of manufacturing, material costs, ball properties, and ball playing performance. For example, three-piece solid golf balls containing an inner core, at least one intermediate layer surrounding the core, and an outer cover surrounding the intermediate layer are generally popular among both avid and recreational golfers. The inner core is made of a rubber material such as natural and synthetic rubbers, styrene butadiene, polybutadiene, poly(cis-isoprene), or poly(trans-isoprene). The intermediate and outer cover layers are made of thermoplastic or thermoset polymers such as ionomer resins, polyolefins, polyamides, polyesters, polyurethanes, and polyureas.

Golf balls having intermediate layers and/or outer covers made of ionomer resins are desirable to many consumers because of their playing performance properties. Particularly, ionomer reins can be used to produce "hard" golf balls having good durability, toughness, and impact strength. Golf balls having a hard ionomer cover are generally resistant to wear and tear caused by a golf club repeatedly striking the ball. Moreover, hard golf balls have a higher compression and players tend to achieve good flight distance when using such golf balls. The "hard" balls tend to travel a farther distance than "soft" balls, which is particularly desirable when hitting the ball off the tee. Ionomers and other tough resins can be used to help make the ball harder and more durable.

"Ionomers" generally refer to ionic copolymers of an olefin such as ethylene and a vinyl comonomer having an acid group such as methacrylic, acrylic acid, or maleic acid. The copolymers contain inter-chain ionic bonding as well as covalent bonding. Metal ions such as sodium, lithium, zinc, and magnesium are used to neutralize the acid groups in the copolymer. Commercially available ionomer resins are used in different industries and include numerous resins sold under the trademarks, Surlyn® (available from DuPont) and Escor® and Iotek® (available from ExxonMobil). Ionomer resins are available in various grades and identified based on the type of base resin, molecular weight, type of metal ion, amount of acid, degree of neutralization, additives, and other properties.

The ionomers can blended with other polymers and ingredients to modify certain properties. For example, the cover material of a golf ball normally contains white pigment or other colored concentrate, or is painted white or other color. A primer coat can be applied to the cover before a logo, symbol, or other mark is ink-printed onto the surface. A clear, protective coating is applied over the printed mark to provide a glossy finish. It is known to prepare cover compositions containing a mixture of ionomer and epoxy group-containing polymers to make the cover more ink-receptive and protect the printed mark.

For example, Fushihara, published US Patent Application 2003/0100385 discloses a multi-piece golf ball containing a rubber core and cover that is formed from a composition comprising a mixture of ionomer and epoxy group-containing polymer. The cover composition contains a white pigment such as titanium dioxide or zinc oxide. No primer coat is needed. A logo or other mark is printed directly on the surface using ink containing a base resin, pigment, and isocyanate compound. The isocyanate compound reacts with the epoxy group of the polymer in the cover material to form a bond. This results in strong adhesion between the printed mark and cover surface.

Fushihara, published US Patent Application 2003/0104880 discloses a multi-piece golf ball having a core and cover made of an ionomer resin. The cover material may be white-pigmented. An epoxy film is applied over the cover material as a primer coating. The epoxy film coating also may be white-pigmented. A logo or other mark may be printed on the epoxy film. Then, a clear polyurethane film is applied over the epoxy coating. The epoxy coating is made by curing an epoxy resin with a polyamide curing agent; and the polyurethane clear coating is made by curing a polyol with an isocyanate curing agent. Because there is good adhesion between the epoxy coating and polyurethane coating, the printed mark does not wear off.

Kamino et al., published US Patent Application 2009/0105012 discloses a multi-piece golf ball. Referring to FIG. 1 in the '012 Publication, the ball contains a rubber core (4), a mid-layer (6) that may be made of a thermoplastic resin such as an ionomer, a reinforcing layer (8) that improves adhesion between the mid-layer, and a cover (10). The reinforcing layer may be made of a two-pack type thermosetting resin such as an epoxy resin that is cured with a polyamide-based curing agent having multiple amine groups and one or more amide groups. The base polymer of the cover material is a thermoplastic polyurethane. The cover is painted with a paint layer (16) that may be a urethane-based resin, epoxy-based resin, or combination thereof. The epoxy paint layer, which has good adhesion to the cover, may be formed by curing an epoxy resin with a polyamide-based curing agent.

As noted above, "hard" golf balls having intermediate and/or cover layers made of ionomer resins have many advantageous properties; however, they also have some drawbacks. For example, players may experience a harder "feel" when their club face makes contact with such golf balls. The player may sense less control over making the shot. The sensation of striking the ball is generally less natural and comfortable with "hard" golf balls versus "soft" golf balls. As opposed to "hard" golf balls, player can better place a spin on "soft" balls and better control their flight pattern. The softer golf ball feels more natural and the player senses more control. Soft golf balls tend to have higher initial spin versus hard golf balls. Balls having higher spin rates are particularly desirable when making approach shots near a golf hole green. Skilled players can place a back-spin on such balls so that they land precisely on a targeted area of the green.

The resiliency or coefficient of restitution ("COR") of a golf ball (or golf ball sub-component such as a core) means the ratio of a ball's rebound velocity to its initial incoming velocity when the ball is fired out of an air cannon into a rigid plate. The COR for a golf ball is written as a decimal value between zero and one. A golf ball may have different COR values at different initial velocities. The United States Golf Association (USGA) sets limits on the initial velocity of the ball so one objective of golf ball manufacturers is to maximize the COR under these conditions. Balls (or cores) with a higher rebound velocity have a higher COR value. Such golf balls rebound faster, retain more total energy when struck with a club, and have longer flight distance. In general, the COR of the ball will increase as the hardness of the ball is increased. The test methods for measuring the COR are described in further detail below.

It would be desirable to develop a cover or intermediate layer material that provides enhanced resiliency along with a soft feel to the golf ball. The material should have good durability, toughness, and impact strength. The material should have high resiliency and COR so that a player can drive the ball long distances. The material, however, should not be so hard and stiff that playing performance properties such as feel, softness, and spin control are sacrificed. One objective of the present invention is to develop a material having an optimum combination of hard and soft properties. The present invention provides a material and the resulting golf ball having these properties as well as other advantageous features and characteristics.

SUMMARY OF THE INVENTION

The present invention provides multi-piece, solid golf balls comprising an inner core, an intermediate layer surrounding the core, and an outer cover. In one embodiment, the intermediate layer is made of an epoxy composition that is prepared by curing an epoxy prepolymer with a metallic (meth) acrylate curing agent. The epoxy prepolymer is preferably formed by reacting a bisphenol A compound with epichlorohydrin. The concentration of the curing agent is 0.1 to 10 percent by weight based on total weight of the composition. The resulting golf ball has a COR value of about 0.60 to about 0.90 and compression of about 70 to about 110. Preferably, the core is made of polybutadiene rubber and the outer cover is made of an ionomer resin, polyolefin, polyamide, polyester, polyurethane, and/or polyurea. In a second embodiment, the outer cover is made of the epoxy composition. The resulting cover preferably has a thickness in the range of about 0.015 to about 0.090 inches and a material hardness in the range of about 30 to about 65 Shore D.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE PREFERRED EMBODIMENTS

Figure 1:
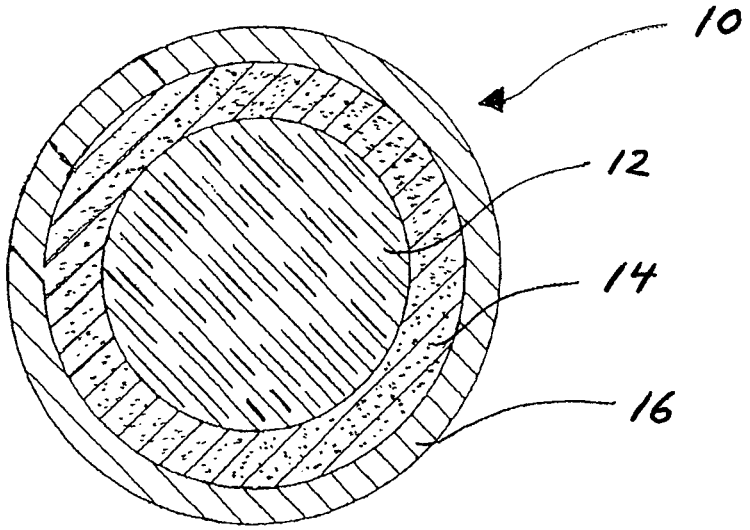
FIG. 1 is a cross-sectional view of a three-piece golf ball having an intermediate layer made of an epoxy composition in accordance with the present invention.

The present invention generally relates to golf balls having an intermediate and/or cover layer made from an epoxy composition produced by curing an epoxy prepolymer with a metallic (meth)acrylate curing agent.

The term, "metallic (meth)acrylate" is meant to include metallic acrylates, metallic diacrylates, metallic monomethacrylates, metallic dimethacrylate compounds, along with other compounds. Any suitable metallic diacrylate can be used in accordance with this invention. Examples of suitable metallic (meth)acrylates include, but are not limited to, zinc diacrylate (ZDA), zinc dimethacrylate (ZDMA), magnesium diacrylate, aluminum diacrylate, aqueous solutions of metallic acrylate monomers, among others. Zinc diacrylates (ZDA) and zinc dimethacrylates (ZDMA) are particularly preferred.

An "epoxy prepolymer" can be prepared by reacting by reacting bisphenol A compound and an epoxy-containing compound such as epichlorohydrin. Other bisphenol compounds such as a bisphenol F or bisphenol AD-type compounds may be used in accordance with this invention. The epoxy prepolymer is cured by reacting it with the metallic (meth)acrylate curing agent. The curing (cross-linking) agent reacts with the epoxy prepolymer to form a cross-linked network.

Core Composition

The cores in the golf balls of this invention are typically made from rubber compositions containing a base rubber, a free-radical initiator agent, cross-linking co-agent, and fillers. The base rubber may be selected from polybutadiene rubber, polyisoprene rubber, natural rubber, ethylene-propylene rubber, ethylene-propylene diene rubber, styrene-butadiene rubber, and combinations of two or more thereof A preferred base rubber is polybutadiene. Another preferred base rubber is polybutadiene optionally mixed with one or more elastomers selected from polyisoprene rubber, natural rubber, ethylene propylene rubber, ethylene propylene diene rubber, styrene-butadiene rubber, polystyrene elastomers, polyethylene elastomers, polyurethane elastomers, polyurea elastomers, metallocene-catalyzed elastomers, and plastomers.

The rubber composition is cured using a conventional curing process. Suitable curing processes include, for example, peroxide curing, sulfur curing, radiation, and combinations thereof. In one embodiment, the base rubber is peroxide cured. Organic peroxides suitable as free-radical initiators include, for example, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. Peroxide free-radical initiators are generally present in the rubber compositions in an amount within the range of 0.05 to 15 parts, preferably 0.1 to 10 parts, and more preferably 0.25 to 6 parts by weight per 100 parts of the base rubber. Cross-linking agents are used to cross-link at least a portion of the polymer chains in the composition. Suitable cross-linking agents include, for example, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particularly suitable metal salts include, for example, one or more metal salts of acrylates, diacrylates, methacrylates, and dimethacrylates, wherein the metal is selected from magnesium, calcium, zinc, aluminum, lithium, and nickel. In a particular embodiment, the cross-linking agent is selected from zinc salts of acrylates, diacrylates, methacrylates, and dimethacrylates. When the cross-linking agent is zinc diacrylate and/or zinc dimethacrylate, the agent typically is included in the rubber composition in an amount within the range of 1 to 60 parts, preferably 5 to 50 parts, and more preferably 10 to 40 parts, by weight per 100 parts of the base rubber.

In a preferred embodiment, the cross-linking agent used in the rubber composition of the core and epoxy composition of the intermediate layer and/or cover layer is zinc diacrylate ("ZDA"). Adding the ZDA curing agent to the rubber composition makes the core harder and improves the resiliency and COR of the ball. Adding the same ZDA curing agent epoxy composition makes the intermediate and cover layers harder and more rigid. As a result, the overall durability, toughness, and impact strength of the ball is improved.

Sulfur and sulfur-based curing agents with optional accelerators may be used in combination with or in replacement of the peroxide initiators to cross-link the base rubber. High energy radiation sources capable of generating free-radicals may also be used to cross-link the base rubber. Suitable examples of such radiation sources include, for example, electron beams, ultra-violet radiation, gamma radiation, X-ray radiation, infrared radiation, heat, and combinations thereof.

The rubber compositions may also contain "soft and fast" agents such as a halogenated organosulfur, organic disulfide, or inorganic disulfide compound. Particularly suitable halogenated organosulfur compounds include, but are not limited to, halogenated thiophenols. Preferred organic sulfur compounds include, but not limited to, pentachlorothiophenol ("PCTP") and a salt of PCTP. A preferred salt of PCTP is ZnPCTP. A suitable PCTP is sold by the Struktol Company (Stow, Ohio) under the tradename, A95. ZnPCTP is commercially available from EchinaChem (San Francisco, Calif.). These compounds also may function as cis-to-trans catalysts to convert some cis-1,4 bonds in the polybutadiene to trans-1,4 bonds. Peroxide free-radical initiators are generally present in the rubber compositions in an amount within the range of 0.05 to 10 parts and preferably 0.1 to 5 parts. Antioxidants also may be added to the rubber compositions to prevent the breakdown of the elastomers. Other ingredients such as accelerators (for example, tetra methylthiuram), processing aids, processing oils, dyes and pigments, wetting agents, surfactants, plasticizers, as well as other additives known in the art may be added to the composition. Generally, the fillers and other additives are present in the rubber composition in an amount within the range of 1 to 70 parts by weight per 100 parts of the base rubber. The core may be formed by mixing and forming the rubber composition using conventional techniques. These cores can be used to make finished golf balls by surrounding the core with outer core layer(s), intermediate layer(s), and/or cover materials as discussed further below.

Intermediate and Cover Layers

Figure 2:
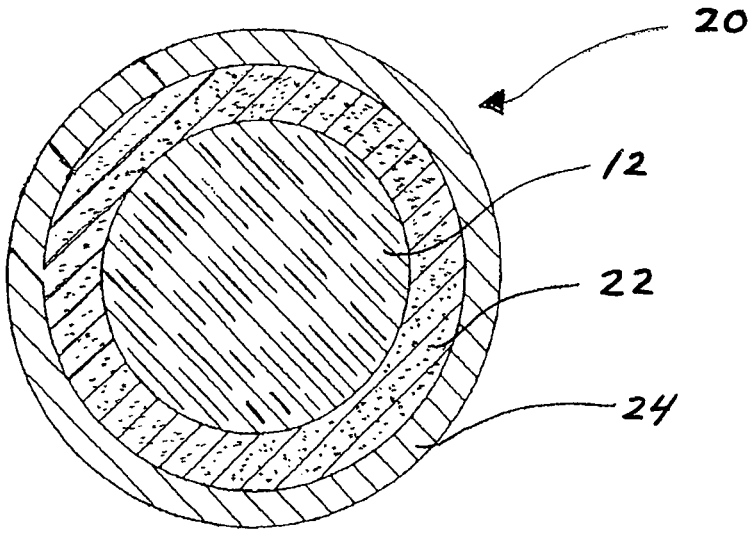
FIG. 2 is a cross-sectional view of a three-piece golf ball having a cover made of an epoxy composition in accordance with the present invention.
Figure 3:
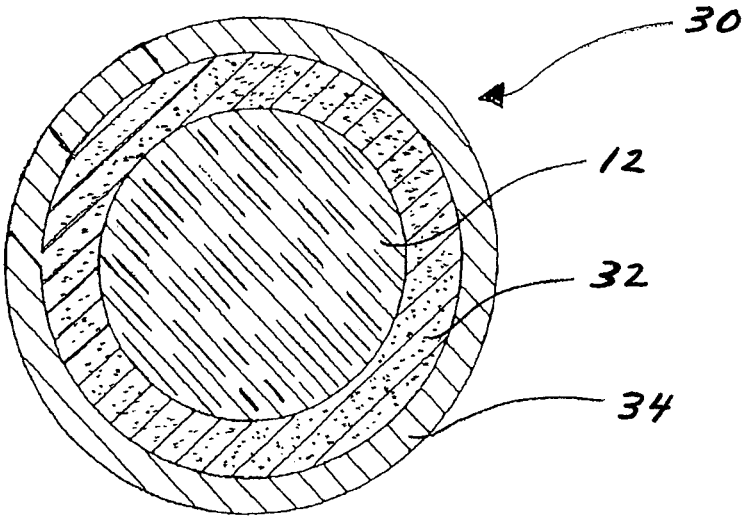
FIG. 3 is a cross-sectional view of a three-piece golf ball having an intermediate layer and cover made of an epoxy composition in accordance with the present invention.

Referring to FIG. 1, one embodiment of a golf ball (10) is shown. The golf ball (10) may include at least one intermediate layer (14) made of the epoxy composition of this invention. As used herein, the term, "intermediate layer" means any layer of the ball disposed between the inner core (12) and outer cover (16). In FIG. 1, the core (12) is made of a rubber composition as described above, while the cover (16) is made of a conventional thermoplastic or thermoset material. The intermediate layer (14) may be considered an outer core layer or inner cover layer or any other layer disposed between the inner core (12) and outer cover (16) of the ball. The intermediate layer (14) also may be referred to as a casing or mantle layer. The ball may include one or more intermediate layers (14). Turning to FIG. 2, a different version of a golf ball (20) made in accordance with this invention is shown. In FIG. 2, the golf ball (20) has a cover layer (24) made of the epoxy composition of this invention, while, the core (12) is made of a rubber composition and the intermediate layer (22) is made of a conventional thermoplastic or thermoset material. Finally, in FIG. 3, a golf ball (30) having intermediate (32) and cover (34) layers made of the epoxy composition of this invention with an inner rubber core (12) is shown. It should be understood that the golf balls shown in FIGS. 1-3 are for illustration purposes only and are not meant to be restrictive. The golf balls of this invention may have a wide variety of constructions.

As noted above, materials, other than the epoxy composition of this invention, may be used to form the intermediate and/or cover layer (so long as at least one layer is made of the epoxy composition.) Suitable thermoplastic polymers that can be used to form the intermediate and/or cover layers of the golf balls of this invention include, but are not limited to, partially- and fully-neutralized ionomers, graft copolymers of ionomer and polyamide, and the following non-ionomeric polymers: polyesters; polyamides; polyamide-ethers, and polyamide-esters; polyurethanes, polyureas, and polyurethane-polyurea hybrids; fluoropolymers; non-ionomeric acid polymers, such as E/Y- and E/X/Y-type copolymers, wherein E is an olefin (e.g., ethylene), Y is a carboxylic acid, and X is a softening comonomer such as vinyl esters of aliphatic carboxylic acids, and alkyl alkylacrylates; metallocene-catalyzed polymers; polystyrenes; polypropylenes and polyethylenes; polyvinyl chlorides and grafted polyvinyl chlorides; polyvinyl acetates; polycarbonates including polycarbonate/acrylonitrile-butadiene-styrene blends, polycarbonate/polyurethane blends, and polycarbonate/polyester blends; polyvinyl alcohols; polyethers; polyimides, polyetherketones, polyamideimides; and mixtures of any two or more of the above thermoplastic polymers.

Examples of commercially available thermoplastics include, but are not limited to: Pebax® thermoplastic polyether block amides, commercially available from Arkema Inc.; Surlyn® ionomer resins, Hytrel® thermoplastic polyester elastomers, and ionomeric materials sold under the trade names DuPont® HPF 1000 and HPF 2000, all of which are commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; Clarix® ionomer resins, commercially available from A. Schulman Inc.; Elastollan® polyurethane-based thermoplastic elastomers, commercially available from BASF; and Xylex® polycarbonate/polyester blends, commercially available from SABIC Innovative Plastics. The additives and filler materials described above may be added to the intermediate layer composition to modify such properties as the specific gravity, density, hardness, weight, modulus, resiliency, compression, and the like.

The ionomeric resins may be blended with non-ionic thermoplastic resins. Examples of suitable non-ionic thermoplastic resins include, but are not limited to, polyurethane, polyether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, polyethylene-(meth)acrylic acid, functionalized polymers with maleic anhydride grafting, and Fusabond® functionalized polymers commercially available from E. I. du Pont de Nemours and Company.

In one embodiment, the thermoplastic composition comprises a thermoplastic polymer selected from the group consisting of ionomers; polyesters; polyamides; polyamide-ethers, and polyamide-esters; polyurethanes, polyureas, and polyurethane-polyurea hybrids; fluoropolymers; polystyrenes; polypropylenes and polyethylenes; polyvinyl chlorides; polyvinyl acetates; polycarbonates; polyvinyl alcohols; polyethers; polyimides, polyetherketones, polyamideimides; and mixtures thereof.

As discussed above, it is preferred that an epoxy composition produced by reacting a epoxy prepolymer with a metallic (meth)acrylate curing agent be used to form the intermediate layer and/or cover layer. Methods for making such epoxy compositions are known in the art and described in the above-mentioned U.S. Pat. Nos. 7,208,538; 7,396,869; and 7,528,189, the disclosures of which are hereby incorporated by reference. The metallic (meth)acrylate (for example, metallic diacrylate, metallic dimethacrylate, or metallic monomethacrylate) curing agents can be easily blended with solid or liquid epoxy resins, or mixtures of liquid and solid resins in order to produce the final composition. Preferably, the metallic (meth)acrylate is selected from zinc diacrylate (ZDA), zinc dimethacrylate (ZDMA), and mixtures thereof. Commercial ZDA and ZDMA are available from Rockland React-Rite and Sartomer.

The golf ball's desired properties must be considered when preparing an epoxy composition containing a metallic (meth) acrylate curing agent. Reacting an epoxy prepolymer with a metallic (meth)acrylate curing agent has both a positive and negative impact on the resulting epoxy composition that will be used as an intermediate and/or cover layer. Particularly, the metallic (meth)acrylate curing agent makes the epoxy composition highly rigid. The stiffness and hardness of the composition are increased significantly. On one hand, this can be advantageous, because the resulting golf ball will likely have enhanced COR. On the other hand, if an excess amount of metallic (meth)acrylate agent is added, the resulting intermediate and/or cover layer will become too stiff. The golf ball will have a hard "feel." With hard golf balls, the player senses less control when the club makes contact, and such balls feel less natural and comfortable. Moreover, if the golf ball is overly stiff, it is more difficult to control and place a spin thereon. In accordance with this invention, it now has been found that an epoxy composition having sufficient "hardness" and softness" for intermediate and/or cover layers can be made. Particularly, the metallic acrylates should be added in an amount of 0.1 to 10% by weight based on total weight of the composition. While not wishing to be bound by any theory, it is believed that adding the curing agent in this amount enhances the rigidity and toughness of the ball. The resulting ball is sufficiently hard and firm so that it has good resiliency as well as durability and impact strength. At the same time, however, the ball is sufficiently soft so that it has a soft feel and good spin control. That is, the ball has sufficient hardness but it is not overly rigid or stiff. In general, the golf ball has a COR value of about 0.60 to about 0.90 and a compression of about 70 to about 110.

The epoxy composition constituting the layer(s) of the golf ball may contain additives, ingredients, and other materials in amounts that do not detract from the properties of the final composition. These materials include, but are not limited to, activators such as calcium or magnesium oxide; fatty acids such as stearic acid and salts thereof; fillers and reinforcing agents such as organic or inorganic particles, for example, clays, talc, calcium, magnesium carbonate, silica, and aluminum silicates; zeolites; metal or metal alloy powders; metal oxides such as iron oxide, aluminum oxide, titanium dioxide, magnesium oxide, zirconium oxide, and tungsten trioxide, carbonaceous materials such as graphite and carbon black, and organic or inorganic fibers; plasticizers such as dialkyl esters of dicarboxylic acids; surfactants; softeners; tackifiers; waxes; ultraviolet (UV) light absorbers and stabilizers; antioxidants; optical brighteners; whitening agents such as titanium dioxide and zinc oxide; color concentrates; dyes and pigments; processing aids; release agents; and wetting agents. If additives are included in the epoxy composition, they are normally present in an amount in the range of about 0.05 to about 10% by weight based on total weight of the composition.

In one version, the polymer matrix constituting the ball layer consists of 100% by weight of the epoxy composition of this invention. In another version, the polymer matrix constituting the ball layer is a blend of the epoxy composition and another polymer. The blend may contain about 10 to about 90% by weight of the epoxy composition and about 90 to about 10% by weight of another polymer such as, for example, vinyl resins, polyolefins, polyamides, polycarbonates, polyesters, polyacrylates. partially- or fully-neutralized ionomeric acid copolymers, non-ionomeric acid copolymers, engineering thermoplastics, fatty acid/salt-based highly neutralized polymers, polybutadienes, polyurethanes, polyureas, polyesters, polycarbonate/polyester blends, thermoplastic elastomers, and the like.

Golf balls made in accordance with this invention can be of any size, although the USGA requires that golf balls used in competition have a diameter of at least 1.68 inches and a weight of no greater than 1.62 ounces. For play outside of USGA competition, the golf balls can have smaller diameters and be heavier. Preferably, the diameter of the golf ball is in the range of about 1.68 to about 1.80 inches. The core generally will have a diameter in the range of about 1.26 to about 1.60 inches. In one preferred version, the single-piece core has a diameter of about 1.57 inches. In general, core hardness is in the range of about 30 to about 70 Shore D and more preferably in the range of about 40 to about 60 Shore D. In FIGS. 1-3, the respective cores (12) are shown as single-piece structures made from a rubber composition. In other instances (not shown), a multi-piece core may be constructed; that is, there may be two or more core pieces made of the same or different rubber materials.

The range of thicknesses for the intermediate layer can vary, but it is generally in the range of about 0.015 to about 0.120 inches and preferably about 0.020 to about 0.060 inches. Multiple intermediate layers may be disposed between the inner core and outer cover. The thickness of the cover may vary, but it is generally in the range of about 0.015 to about 0.090 inches, preferably about 0.020 to about 0.050 inches, and more preferably about 0.020 inches to about 0.035 inches.

The golf balls of this invention may contain layers having the same hardness or different hardness values. The core generally has a surface hardness is in the range of about 30 to about 70 Shore D and more preferably in the range of about 40 to about 60 Shore D. The hardness of the intermediate and cover layers may vary, but the intermediate layer preferably has a material hardness in the range of about 30 to about 75 Shore D, and the cover layer preferably has a material hardness in the range of about 30 to about 65 Shore D. The test methods for measuring hardness are described in detail below.

The golf balls of this invention may be constructed using any suitable technique known in the art. These methods generally include compression molding, flip molding, injection molding, retractable pin injection molding, reaction injection molding (RIM), liquid injection molding (LIM), casting, vacuum forming, powder coating, flow coating, spin coating, dipping, spraying, and the like.

The epoxy composition of this invention may be used with any type of ball construction known in the art. Such golf ball designs include, for example, single-piece, two-piece, three-piece, and four-piece designs. The core, intermediate (casing), and cover portions making up the golf ball each can be single or multi-layered depending upon the desired playing performance properties. As discussed above, in preferred embodiments, the epoxy composition of this invention is used in an intermediate and/or cover layer, each of which may be single or multi-layered. In other embodiments, the epoxy composition may be used to form a core. That is, the epoxy composition may be used in any golf ball construction so long as at least one layer comprises an epoxy composition prepared in accordance with this invention.

Test Methods

Hardness:

The surface hardness of a golf ball layer (or other spherical surface such as a core) is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the object, care must be taken to ensure that the golf ball or component (for example, a core) is centered under the durometer indentor before a surface hardness reading is obtained. A calibrated digital durometer, capable of reading to 0.1 hardness units, is used for all hardness measurements and is set to take the maximum hardness reading. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

Compression:

In the present invention, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in *Compression by Any Other Name, Science and Golf IV, Proceedings of the World Scientific Congress of Golf* (Eric Thain ed., Routledge, 2002) ("J. Dalton").

Coefficient of Restitution (COR):

In the present invention, COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculates as the ratio of the ball's outgoing transit time period to the ball's incoming transit time period ($COR=V_{out}N_{in}=T_{in}/T_{out}$).

It is understood that the golf balls described and illustrated herein represent only presently preferred embodiments of the invention. It is appreciated by those skilled in the art that various changes and additions can be made to such golf balls without departing from the spirit and scope of this invention. It is intended that all such embodiments be covered by the appended claims.

We claim:

1. A multi-piece solid golf ball, comprising an inner core, an intermediate layer surrounding the core, and an outer cover, wherein the intermediate layer comprises a blend composition of epoxy, polybutadiene, metallic (meth)acrylate curing agent, and zinc pentachlorothiophenol, the epoxy being present in an amount of 10% to 90% and the polybutadiene being present in an amount of 90% to 10% based on weight of polymer, wherein the epoxy is produced by curing an epoxy prepolymer with the metallic (meth)acrylate curing agent and the polybutadiene is cured with the same metallic (meth)acrylate curing agent, the curing agent being present in the amount of 0.1 to 10 percent by weight based on total weight of composition, the golf ball having a COR value of about 0.60 to about 0.90 and a compression of about 70 to about 110.

2. The golf ball of claim 1, wherein the core comprises polybutadiene rubber.

3. The golf ball of claim 1, wherein the epoxy prepolymer is formed by reacting a bisphenol A compound with epichlorohydrin.

4. The golf ball of claim 1, wherein the outer cover comprises a material selected from the group consisting of ionomer resins, polyolefins, polyamides, polyesters, polyurethanes, and polyureas.

5. The golf ball of claim 1, wherein the intermediate layer has a thickness in the range of about 0.015 to about 0.120 inches and a material hardness in the range of about 30 to about 75 Shore D.

6. The golf ball of claim 1, wherein the cover has a thickness in the range of about 0.015 to about 0.090 inches and a material hardness in the range of about 30 to about 65 Shore D.

* * * * *